US010570851B2

(12) United States Patent
Gong

(10) Patent No.: US 10,570,851 B2
(45) Date of Patent: Feb. 25, 2020

(54) HEAT ENGINE

(71) Applicant: Bingxin Gong, Guangdong (CN)

(72) Inventor: Bingxin Gong, Guangdong (CN)

( * ) Notice: Subject to any disclaimer, the term of this patent is extended or adjusted under 35 U.S.C. 154(b) by 214 days.

(21) Appl. No.: 15/414,620

(22) Filed: Jan. 25, 2017

(65) Prior Publication Data

US 2017/0130671 A1 May 11, 2017

Related U.S. Application Data

(63) Continuation of application No. PCT/CN2015/084542, filed on Jul. 21, 2015.

(30) Foreign Application Priority Data

Jul. 28, 2014 (CN) ..... 2014 1 0369209
Aug. 12, 2014 (CN) ..... 2014 1 0399599

(51) Int. Cl.
*F02G 1/047* (2006.01)
*F02G 1/043* (2006.01)
(Continued)

(52) U.S. Cl.
CPC ..... *F02G 1/047* (2013.01); *F01K 23/02* (2013.01); *F01K 25/08* (2013.01); *F02G 1/043* (2013.01); *F02G 1/044* (2013.01); *F02G 1/055* (2013.01)

(58) Field of Classification Search
CPC ..... F01K 25/08; F01K 25/00; F01K 25/10; F01K 25/103; F01K 25/106; F01K 21/00; F01K 21/02; F01K 7/00; F01K 27/00; F02G 1/043; F02G 1/044; F02G 1/045; F02G 1/047; F02G 1/05; F02G 1/055; F02G 2243/00; F02G 2244/00; F02G 2250/00; F02G 2290/00
(Continued)

(56) References Cited

U.S. PATENT DOCUMENTS 3,956,894 A * 5/1976 Tibbs ..... F02G 1/02 60/508
3,956,895 A * 5/1976 Noble ..... F04B 25/02 60/516
(Continued)

FOREIGN PATENT DOCUMENTS

CN 103557088 A 2/2014

OTHER PUBLICATIONS

1st Office Action of counterpart Chinese Patent Application No. 201410369209.5 dated Jun. 26, 2015.

*Primary Examiner* — Mark A Laurenzi
*Assistant Examiner* — Mickey H France

(57) ABSTRACT

A heat engine includes two kinds of thermodynamic cycles, wherein a thermodynamic cycle 1 is composed of four processes: an isothermal exothermic compression process, an isochoric endothermic heating process, an isothermal endothermic expansion process and an isochoric exothermic cooling process, and the thermodynamic cycle 1 is composed of two loops, and the structure thereof includes a cylinder #1, a cylinder #2, a cylinder #3, a turbo expander or a double-shaft double-acting cylinder and an airproof container; and a thermodynamic cycle 2 is composed of three processes: an isothermal endothermic expansion and working process, an isobaric exothermic compression process and an isochoric endothermic heating process, and the thermodynamic cycle 2 is composed of two loops, and the structure thereof includes a heat insulating cylinder #1, a heat insulating cylinder #2, a condenser #1, a condenser #2, a cylinder #3, a turbo expander or a double-shaft double-acting cylinder and an airproof container.

7 Claims, 8 Drawing Sheets

(51) Int. Cl.

| | |
|---|---|
| ***F01K 23/02*** | (2006.01) |
| ***F01K 25/08*** | (2006.01) |
| ***F02G 1/044*** | (2006.01) |
| ***F02G 1/055*** | (2006.01) |

(58) Field of Classification Search
USPC ..... 60/643, 659, 662, 663, 670, 671, 674, 60/682, 516–526, 698
See application file for complete search history.

(56) References Cited

U.S. PATENT DOCUMENTS

| | | | | |
|---|---|---|---|---|
| 5,256,172 | A * | 10/1993 | Keefer | B01D 53/047 423/220 |
| 8,539,772 | B2 * | 9/2013 | Hurtado | F03G 7/06 60/641.6 |
| 2005/0172631 | A1 * | 8/2005 | Primlani | F23C 99/00 60/698 |
| 2011/0061379 | A1 * | 3/2011 | Misselhorn | F01K 7/00 60/531 |
| 2011/0061741 | A1 * | 3/2011 | Ingersoll | F02G 1/044 137/14 |
| 2011/0100738 | A1 * | 5/2011 | Russo | B60K 6/24 180/65.245 |
| 2012/0067040 | A1 * | 3/2012 | Pinto | F02G 1/043 60/517 |
| 2013/0091834 | A1 * | 4/2013 | McBride | F01B 1/01 60/327 |
| 2013/0269335 | A1 * | 10/2013 | Lecanu | F02C 1/007 60/525 |
| 2014/0007569 | A1 * | 1/2014 | Gayton | F02G 1/055 60/508 |
| 2017/0130671 | A1 * | 5/2017 | Gong | F02G 1/043 |

* cited by examiner

T-S diagram

HEAT ENGINE

CROSS-REFERENCE TO RELATED APPLICATIONS

The present application is a Continuation Application of PCT application No. PCT/CN2015/084542 filed on Jul. 21, 2015, which claims the benefit of Chinese Patent Application No. 201410369209.5 filed on Jul. 28, 2014 and Chinese Patent Application No. 201410399599.0 filed on Aug. 12, 2014, the contents of which are hereby incorporated by reference.

TECHNICAL FIELD

The present invention provides a heat engine using air, water or a refrigerant as a working substance. The heat engine comprises two kinds of thermodynamic cycles, each of which is able to output power, wherein a thermodynamic cycle 1 is similar to the Stirling cycle and is composed of four processes: an isothermal exothermic compression process, an isochoric endothermic heating process, an isothermal endothermic expansion process and an isochoric exothermic cooling process, and the thermodynamic cycle 1 is composed of two loops, and the structure thereof comprises a cylinder #1, a cylinder #2, a cylinder #3, a turbo expander or a double-shaft double-acting cylinder and an airproof container; and a thermodynamic cycle 2 is composed of three processes: an isothermal endothermic expansion and working process, an isobaric exothermic compression process and an isochoric endothermic heating process, and the thermodynamic cycle 2 is composed of two loops, and the structure thereof comprises a heat insulating cylinder #1, a heat insulating cylinder #2, a condenser #1, a condenser #2, a cylinder #3, a turbo expander or a double-shaft double-acting cylinder and an airproof container. Such a heat engine can do work by means of the pressure inside the airproof container, and therefore the output work and efficiency of the heat engine are both higher than those of conventional heat engines.

BACKGROUND ART

We know that the energy consumption of the conventional heat engines is relatively high, and the world faces the problems of global warming and depletion of fossil fuels, conventional Stirling heat engines cannot use the atmospheric pressure to do work.

SUMMARY OF THE INVENTION

In order to solve the above-mentioned problems, the present invention provides a heat engine capable of utilizing the pressure in an airproof container. The heat engine uses air, water or a refrigerant as a working substance, comprising two kinds of thermodynamic cycles, each of which is able to output power, wherein a thermodynamic cycle 1 is similar to the Stirling cycle and is composed of four processes: an isothermal exothermic compression process, an isochoric endothermic heating process, an isothermal endothermic expansion process and an isochoric exothermic cooling process, the thermodynamic cycle 1 is composed of two loops, and the structure thereof comprises a cylinder #1, a cylinder #2, a cylinder #3, an turbo expander or a double-shaft double-acting cylinder, a heat exchanger, a pressure control valve, a temperature control valve, an electric heater and a airproof container, the working substance is subjected to the isochoric exothermic cooling process in the cylinder #1 and the cylinder #2, and is then subjected to the isothermal exothermic compression process by virtue of the pressure in the airproof container, the working substance in the cylinder #3 absorbs heat from the heat reservoir and the heat released from the cylinder #1 and the cylinder #2, the working substance is subjected to the isochoric endothermic heating process in the cylinder #3, and the working substance in the turbo expander or the double-acting cylinder absorbs heat from the heat reservoir and is subjected to the isothermal endothermic expansion process; a thermodynamic cycle 2 is composed of three processes: an isothermal endothermic expansion and working process, an isobaric exothermic compression process and an isochoric endothermic heating process, and the thermodynamic cycle 2 is composed of two loops, and the structure thereof comprises a heat insulating cylinder #1, a heat insulating cylinder #2, a condenser #1, a condenser #2, a cylinder #3, a turbo expander or a double-shaft double-acting cylinder, a heat exchanger, a pressure control valve, a temperature control valve, an electric heater and an airproof container, the working substance is subjected to the isobaric exothermic compression process in the condenser #1 and the condenser #2 by virtue of the pressure in the airproof container, the working substance in the cylinder #3 absorbs heat from the heat reservoir and the heat released from the condenser #1 and the condenser #2, the working substance is subjected to the isochoric endothermic heating process in the cylinder #3, and the working substance in the turbo expander or the double-acting cylinder absorbs heat from the heat reservoir and is subjected to the isothermal endothermic expansion process.

The thermodynamic cycle 1 is composed of two loops, wherein in a loop 1, the working substance firstly enters the turbo expander or the double-shaft double-acting cylinder from a section A of the cylinder #3, then enters the cylinder #2, and finally returns to the section A of the cylinder #3; and in a loop 2, the working substance firstly enters a section B of the cylinder #3 from the cylinder #1, then enters the turbo expander or the double-shaft double-acting cylinder, and finally returns to the cylinder #1.

The cylinder #1 and the cylinder #2 are double-acting cylinders, the structures and volumes of the cylinder #1 and the cylinder #2 are the same, air holes on the rodless sides of the cylinder #1 and the cylinder #2 are respectively connected to a T-connector an opening of which is connected to the cylinder #1 and the cylinder #2 and the other two openings are respectively connected with an inlet valve and an outlet valve of the cylinder #1 and the cylinder #2, the inlet valve is connected to an outlet of the turbo expander or an air hole of the double-shaft double-acting cylinder, the outlet valve is connected to an inlet of the cylinder #3, and air holes on the rod sides of the cylinder #1 and the cylinder #2 are connected to the airproof container.

The airproof container is filled with normal pressure or high pressure air, and the pressure of the outlet of the turbo expander or the double-shaft double-acting cylinder is greater than or equal to the air pressure in the airproof container.

The cylinder #3 is a double-acting cylinder having a volume equal to that of the cylinder #1 and the cylinder #2, a piston of the cylinder #3 divides the cylinder into two sections A, B, two sides of the piston have the same pressure-receiving area, the working substance is subjected to the isochoric endothermic heating process in the cylinder #3, and two air holes of the two sections A and B of the cylinder #3 are respectively connected to a T-connector one opening of which is connected to the cylinder #1 and the cylinder #2 and the other opening is connected to the turbo expander or the double-shaft double-acting cylinder; the outlet valve of the cylinder #2 is provided between the section A of the cylinder #3 and the cylinder #2, this outlet valve is the inlet valve of the section A of the cylinder #3, and an outlet valve is provided between the section A of the cylinder #3 and the turbo expander or the double-shaft double-acting cylinder; and the outlet valve of the cylinder #1 is provided between the section B of the cylinder #3 and the cylinder #1, this outlet valve is the inlet valve of the section B of the cylinder #3, and an outlet valve is provided between the section B of the cylinder #3 and the turbo expander or the double-shaft double-acting cylinder.

The section A of the cylinder #3 absorbs heat from the heat reservoir and the heat released from the cylinder #1, the working substance is subjected to the isochoric endothermic heating process in the section A of the cylinder #3, the working substance is firstly subjected to the isochoric exothermic cooling process in the cylinder #1, when the temperature of the section A of the cylinder #3 is equal to the temperature of the heat reservoir, the outlet valve between the section A of the cylinder #3 and the turbo expander or the double-shaft double-acting cylinder is opened, and the working substance does work on the turbo expander or the double-shaft double-acting cylinder, when the pressure of the section A of the cylinder #3 is equal to the inside pressure of the airproof container, the piston of the cylinder #1 is released and the pressure in the airproof container does work on the working substance in the cylinder #1, which work is used by the heat engine, and the working substance is subjected to the isothermal exothermic compression process in the cylinder #1; and the section B of the cylinder #3 absorbs heat from the heat reservoir and the heat released from the cylinder #2, the working substance is subjected to the isochoric endothermic heating process in the section B of the cylinder #3, the working substance is firstly subjected to the isochoric exothermic cooling process in the cylinder #2, when the temperature of the section B of the cylinder #3 is equal to the temperature of the heat reservoir, the outlet valve between the section B of the cylinder #3 and the turbo expander or the double-shaft double-acting cylinder is opened, and the working substance does work on the turbo expander or the double-shaft double-acting cylinder, when the pressure of the section B of the cylinder #3 is equal to the inside pressure of the airproof container, the piston of the cylinder #2 is released and the pressure in the airproof container does work on the working substance, which work is used by the heat engine, and the working substance is subjected to the isothermal exothermic compression process in the cylinder #2.

All the valves are closed at the beginning, the piston of the cylinder #3 is at the end of the section B, there is no working substance remaining in the section B of the cylinder #3, the piston of the cylinder #2 is situated at the bottom of the cylinder, and the piston of the cylinder #1 is situated at the top of the cylinder; in the loop 1, initially, the pressure of the working substance in the cylinder #1 is equal to the inside pressure of the airproof container and the temperature is equal to the temperature of the heat reservoir, and the pressure of the working substance in the section A of the cylinder #3 is equal to the inside pressure of the airproof container and the temperature is equal to the room temperature; the working substance is firstly subjected to the isochoric exothermic process in the cylinder #1, the heat is transferred to the working substance in the section A of the cylinder #3, when the temperature of the working substance in the section A of the cylinder #3 rises to be equal to the temperature of the heat reservoir, the outlet valve of the section A of the cylinder #3 is opened and the inlet valve of the cylinder #2 is opened at the same time, the working substance then enters the turbo expander or the double-shaft double-acting cylinder from the section A of the cylinder #3 and does work on the turbo expander or the double-shaft double-acting cylinder, the working substance enters the cylinder #2 after exiting the turbo expander or the double-shaft double-acting cylinder, and when the piston of the cylinder #2 moves to the top of the cylinder, the piston remains in a fixed position at the top of the cylinder, in this case, the pressure of the working substance in the cylinder #2 is equal to the inside pressure of the airproof container and the temperature is equal to the temperature of the heat reservoir; when the pressure of the section A of the cylinder #3 is equal to the inside pressure of the airproof container, and the temperature of the working substance in the cylinder #1 is equal to the room temperature, the piston of the cylinder #1 is released, the outlet valve of the cylinder #1 is opened at the same time, the pressure in the airproof container does work on the working substance, which work is used by the heat engine, this process is the isothermal exothermic compression and working process, after which the piston of the cylinder #3 is pushed to the end of the section A, and the working substance, which is originally in the cylinder #1, enters the section B of the cylinder #3, in this case, the piston of the cylinder #1 is situated at the bottom of the cylinder, there is no working substance remaining in the cylinder #1, and the pressure of the working substance in the section B of the cylinder #3 is equal to the inside pressure of the airproof container and the temperature is equal to the room temperature; and in the loop 2, the working substance is firstly subjected to the isochoric exothermic process in the cylinder #2, the heat is transferred to the working substance in the section B of the cylinder #3, when the temperature of the working substance in the section B of the cylinder #3 rises to be equal to the temperature of the heat reservoir, the outlet valve of the section B of the cylinder #3 is opened and the inlet valve of the cylinder #1 is opened at the same time, the working substance then enters the turbo expander or the double-shaft double-acting cylinder from the section B of the cylinder #3 and does work on the turbo expander or the double-shaft double-acting cylinder, the working substance enters the cylinder #1 after exiting the turbo expander or the double-shaft double-acting cylinder, and when the piston of the cylinder #1 moves to the top of the cylinder, the piston remains in a fixed position at the top of the cylinder #1, in this case, the pressure of the working substance in the cylinder #1 is equal to the inside pressure of the airproof container and the temperature is equal to the temperature of the heat reservoir, and the heat engine completes one cycle.

The thermodynamic cycle 2 is composed of two loops, wherein in a loop 1, the working substance firstly enters the turbo expander or the double-shaft double-acting cylinder from a section A of the cylinder #3, then enters the heat insulating cylinder #2, and then enters the condenser #2 from the heat insulating cylinder #2, and the working substance is subjected to the isobaric exothermic compression process in the condenser #2, the section B of the cylinder #3 absorbs heat released from the condenser #2, and finally the working substance returns from the condenser #2 to the section A of the cylinder #3; and in a loop 2, the working substance firstly enters the condenser #1 from the heat insulating cylinder #1, the working substance is subjected to the isobaric exothermic compression process in the condenser #1, the section A of the cylinder #3 absorbs heat released from the condenser #1, then the working substance enters the section B of the cylinder #3 from the condenser #1, and then enters the turbo expander or the double-shaft double-acting cylinder, and finally returns to the heat insulating cylinder #1, the working substance is subjected to the isochoric endothermic heating process in the sections A and B of the cylinder #3, and the turbo expander or the double-acting cylinder is a power output mechanism when the working substance isothermal is subjected to the isothermal endothermic expansion.

Figure 1:
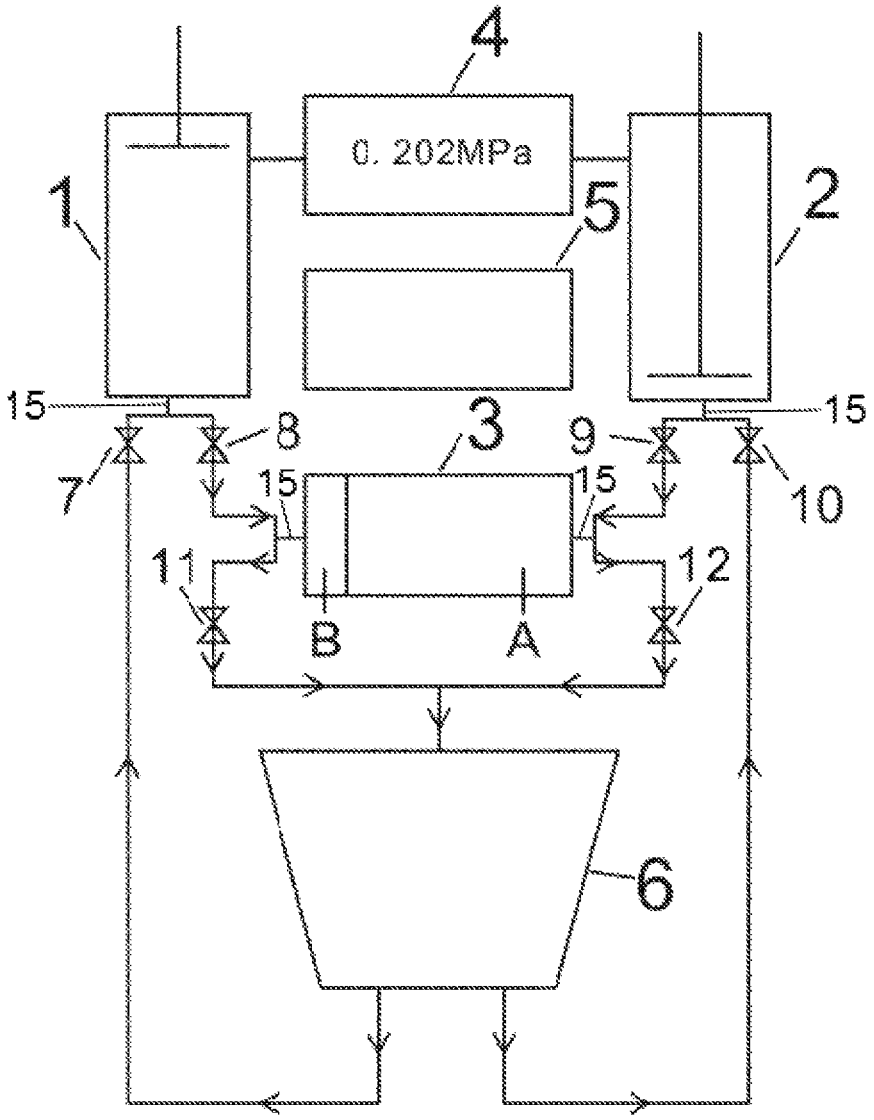
FIG. 1 is a schematic diagram of the thermodynamic thermodynamic cycle 1 and its structure of the present invention.

In the drawings: 1. cylinder #1; 2. cylinder #2; 3. cylinder #3; 4. airproof container; 5. heat exchanger; 6. turbo expander; 7. inlet valve of the cylinder #1; 8. outlet valve of the cylinder #1; 9. outlet valve of the cylinder #2; 10. inlet valve of the cylinder #2; 11. outlet valve in section A of the cylinder #3; 12. outlet valve in section B of the cylinder #3; A. section A of the cylinder #3; B. sections B of the cylinder #3.

Figure 2:
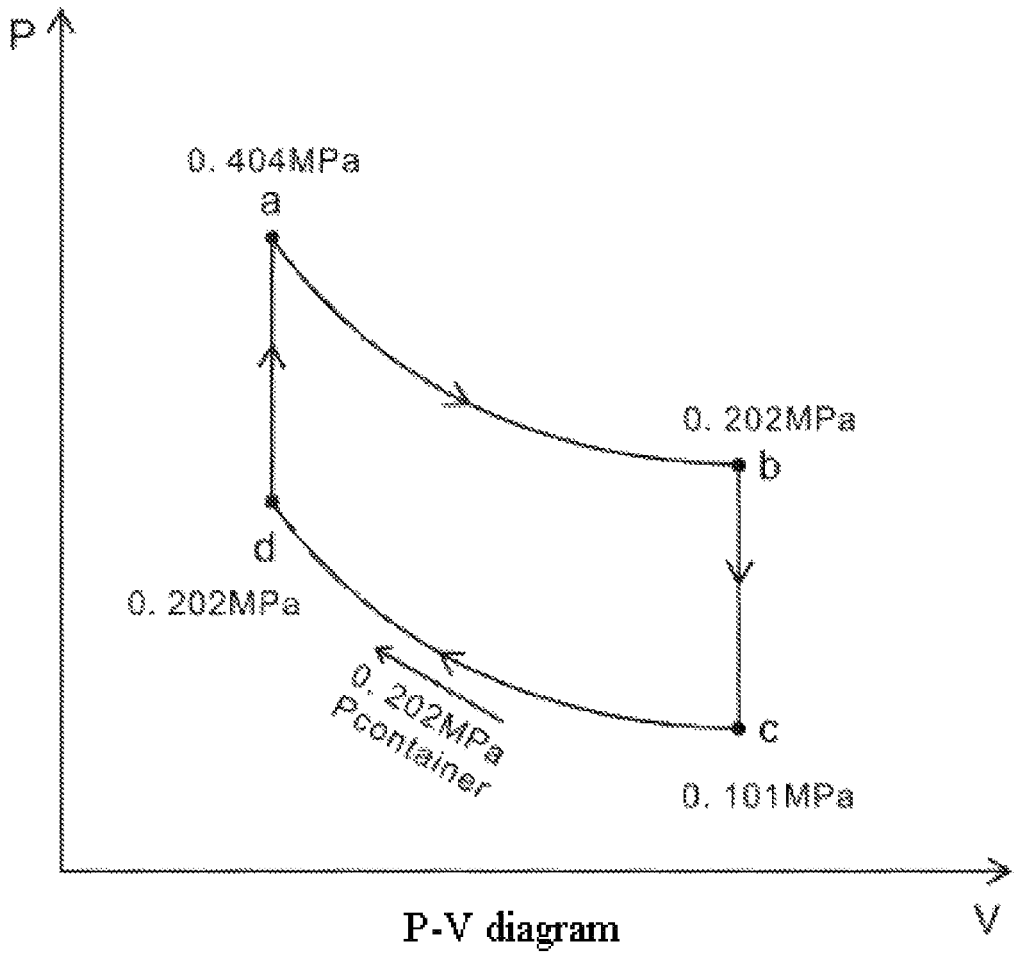

FIG. 2 is a P-V diagram of the thermodynamic thermodynamic cycle 1 of the present invention.

In the drawings: a. pressure of inlet of the turbo expander; b. pressure of outlet of the turbo expander; c. pressure after the isochoric exothermic process; d. pressure after the isothermal exothermic compression process.

Figure 3:
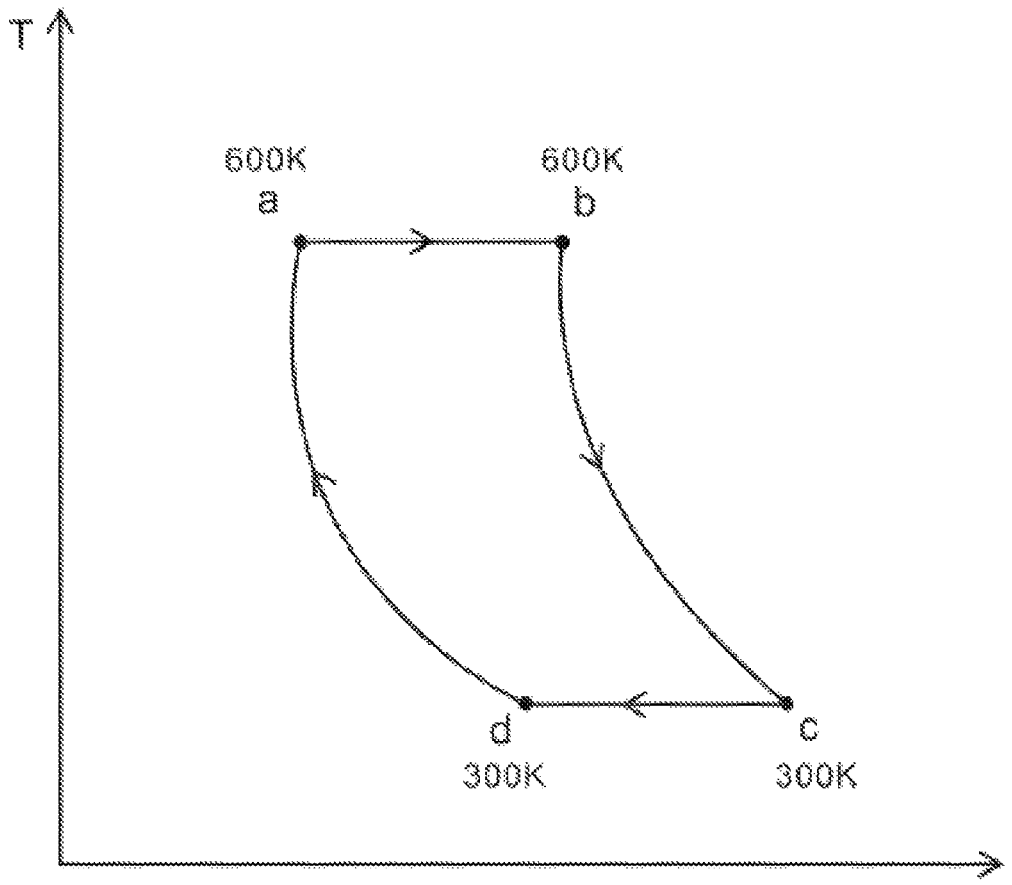

FIG. 3 is a T-S diagram of the thermodynamic thermodynamic cycle 1 of the present invention.

In the drawings: a. temperature of inlet of the turbo expander; b. temperature of outlet of the turbo expander; c. temperature after the isochoric exothermic process; d. temperature after the isothermal exothermic compression process.

Figure 4:
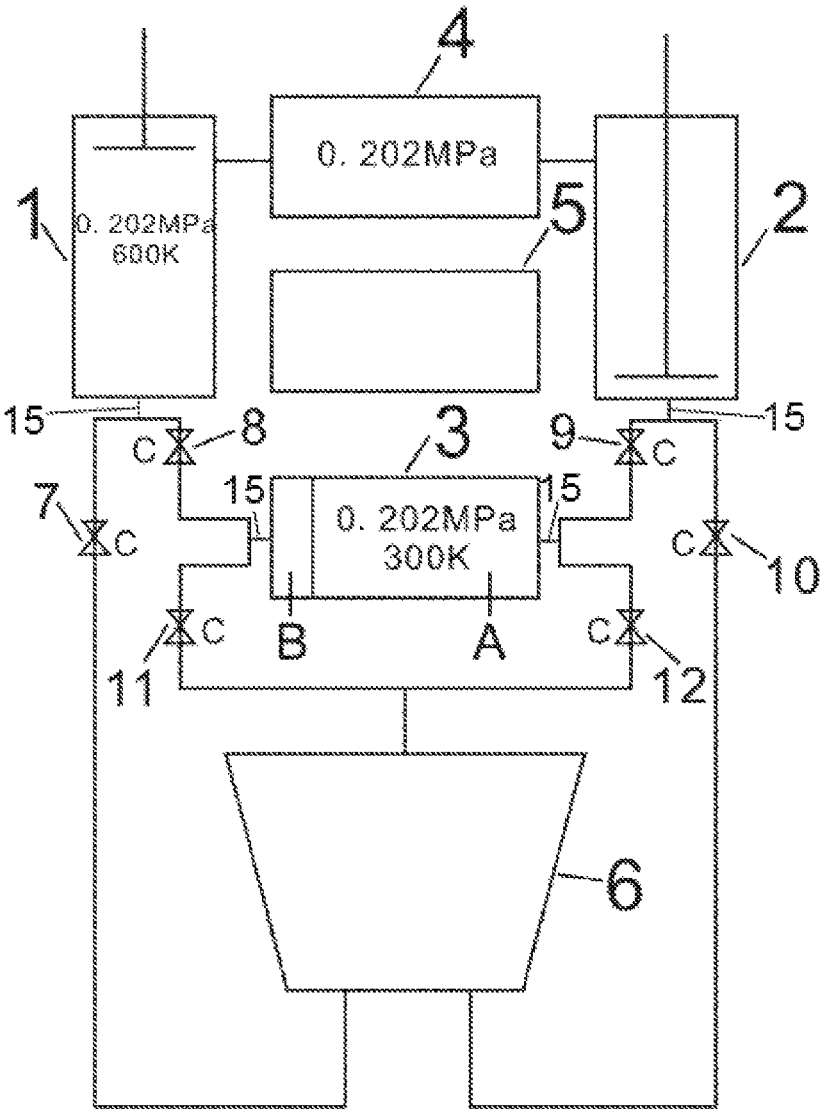

FIG. 4 is a schematic diagram of a particular embodiment of the thermodynamic thermodynamic cycle 1 of the present invention.

In the drawings: 1. cylinder #1; 2. cylinder #2; 3. cylinder #3; 4. airproof container; 5. heat exchanger; 6. turbo expander; 7. inlet valve of the cylinder #1; 8.

outlet valve of the cylinder #1; 9. outlet valve of the cylinder #2; 10. inlet valve of the cylinder #2; 11. outlet valve in section A of the cylinder #3; 12. outlet valve in section B of the cylinder #3; A. section A of the cylinder #3; B. sections B of the cylinder #3; c. close.

Figure 5:
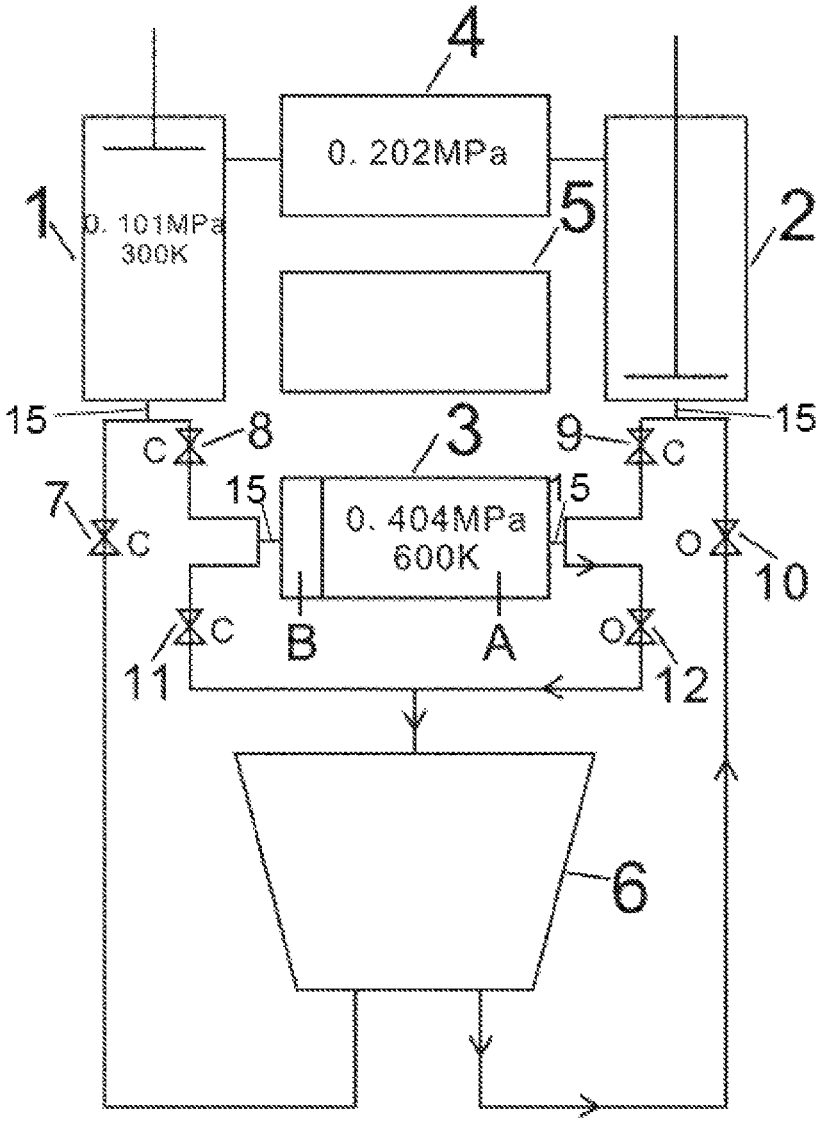

FIG. 5 is a schematic diagram of a particular embodiment of the thermodynamic thermodynamic cycle 1 of the present invention.

In the drawings: 1. cylinder #1; 2. cylinder #2; 3. cylinder #3; 4. airproof container; 5. heat exchanger; 6. turbo expander; 7. inlet valve of the cylinder #1; 8. outlet valve of the cylinder #1; 9. outlet valve of the cylinder #2; 10. inlet valve of the cylinder #2; 11. outlet valve in section A of the cylinder #3; 12. outlet valve in section B of the cylinder #3; A. section A of the cylinder #3; B. sections B of the cylinder #3; c. close; o. open.

Figure 6:
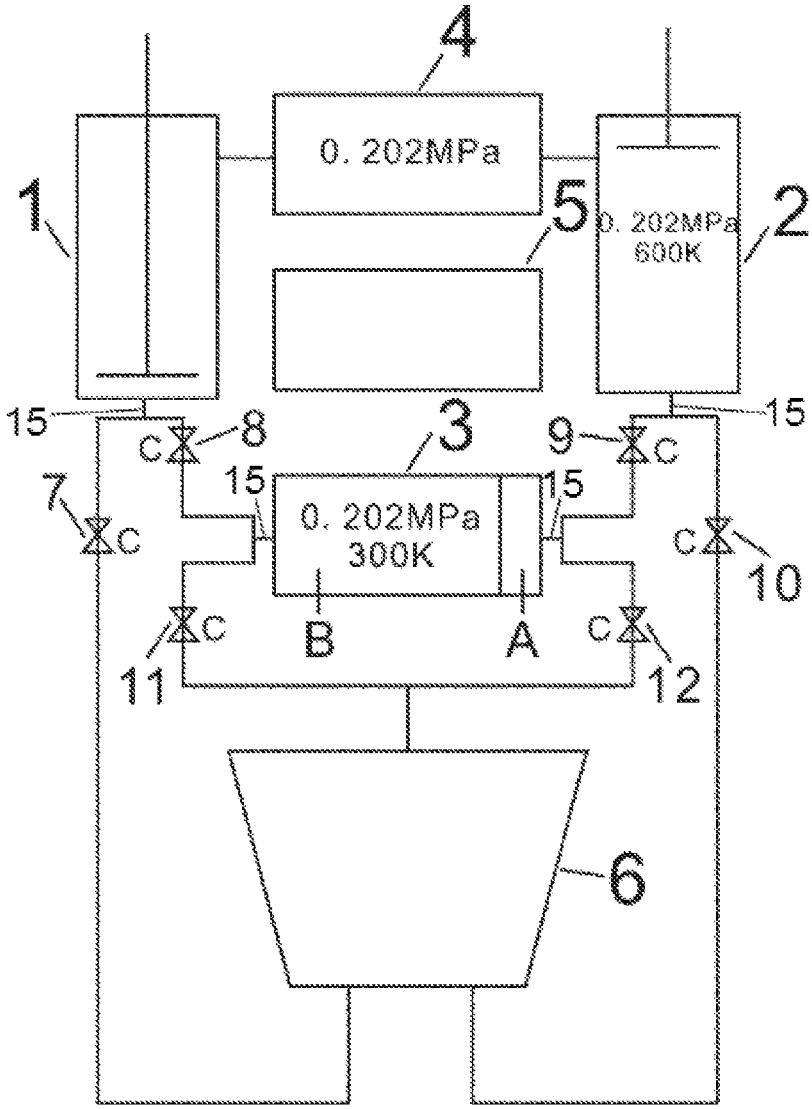

FIG. 6 is a schematic diagram of a particular embodiment of the thermodynamic thermodynamic cycle 1 of the present invention.

In the drawings: 1. cylinder #1; 2. cylinder #2; 3. cylinder #3; 4. airproof container; 5. heat exchanger; 6. turbo expander; 7. inlet valve of the cylinder #1; 8. outlet valve of the cylinder #1; 9. outlet valve of the cylinder #2; 10. inlet valve of the cylinder #2; 11. outlet valve in section A of the cylinder #3; 12. outlet valve in section B of the cylinder #3; A. section A of the cylinder #3; B. sections B of the cylinder #3; c. close; o. open.

Figure 7:
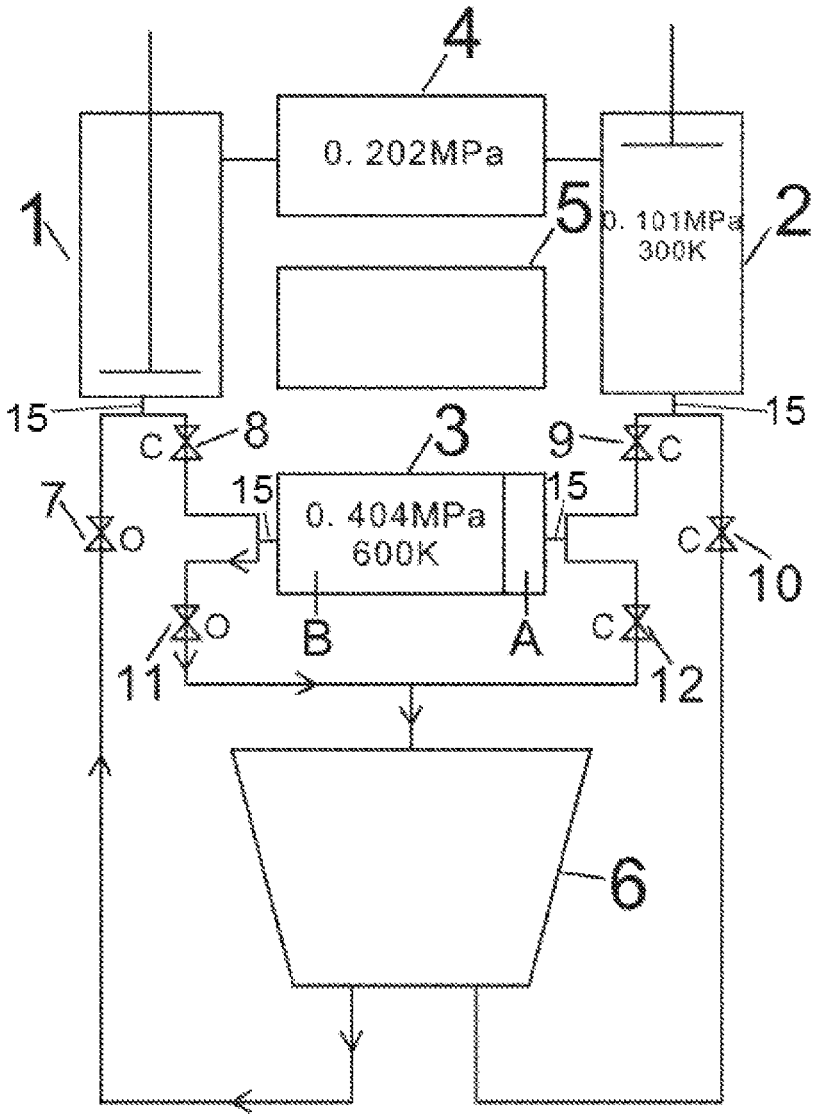

FIG. 7 is a schematic diagram of a particular embodiment of the thermodynamic thermodynamic cycle 1 of the present invention.

In the drawings: 1. cylinder #1; 2. cylinder #2; 3. cylinder #3; 4. airproof container; 5. heat exchanger; 6. turbo expander; 7. inlet valve of the cylinder #1; 8. outlet valve of the cylinder #1; 9. outlet valve of the cylinder #2; 10. inlet valve of the cylinder #2; 11. outlet valve in section A of the cylinder #3; 12. outlet valve in section B of the cylinder #3; A. section A of the cylinder #3; B. sections B of the cylinder #3; c. close; o. open.

Figure 8:
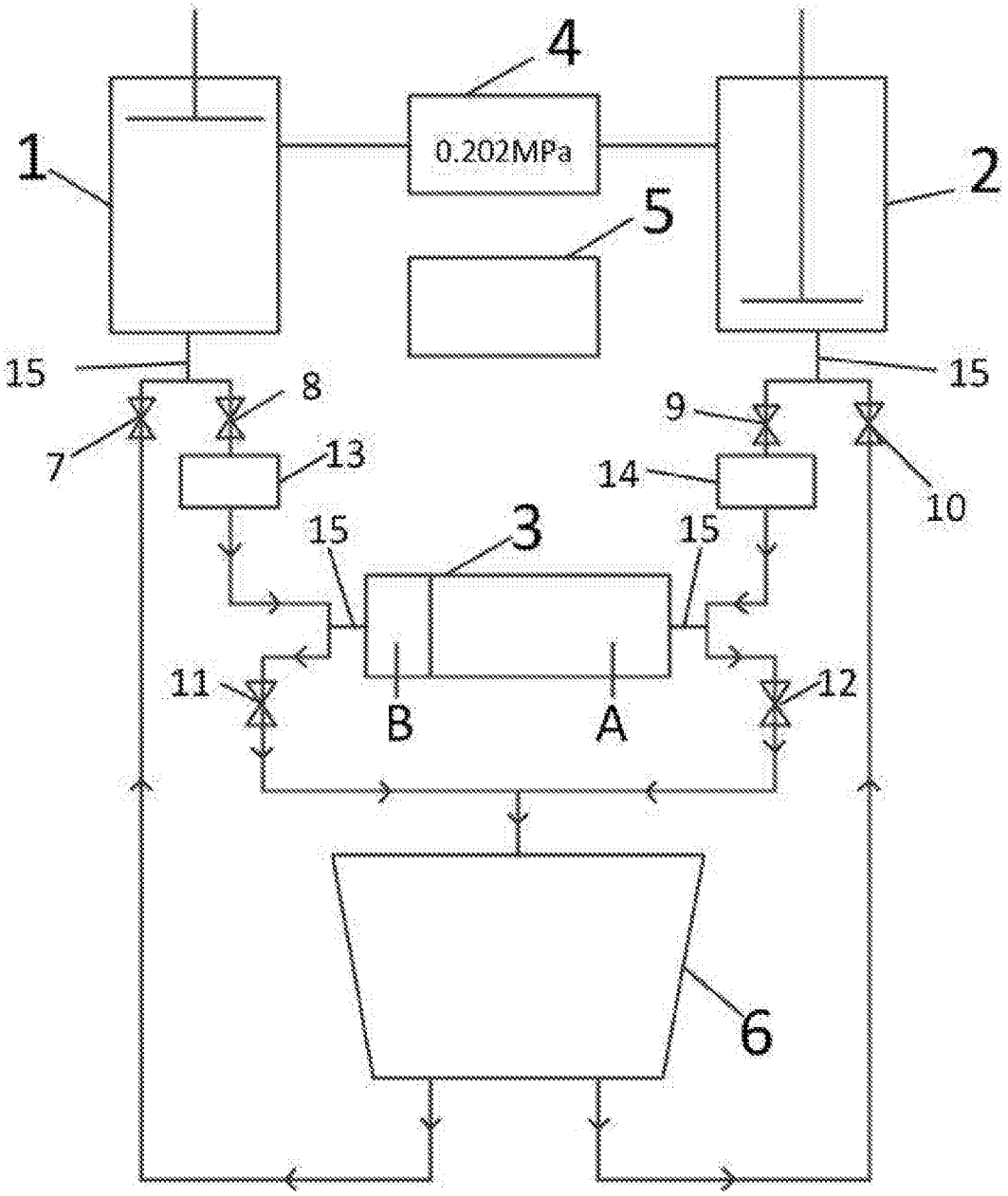

FIG. 8 is a schematic diagram of the thermodynamic thermodynamic cycle 2 and its structure of the present invention.

In the drawings: 1. heat insulating cylinder #1; 2. heat insulating cylinder #2; 3. cylinder #3; 4. airproof container; 5. heat exchanger; 6. turbo expander; 7. inlet valve of the cylinder #1; 8. outlet valve of the cylinder #1; 9. outlet valve of the cylinder #2; 10. inlet valve of the cylinder #2; 11. outlet valve in section A of the cylinder #3; 12. outlet valve in section B of the cylinder #3; A. section A of the cylinder #3; B. sections B of the cylinder #3; 13. condenser #1; 14. condenser #2; 15. T-connectors #1, #2, #3A, #3B.

DETAILED DESCRIPTION

Hereinafter, a particular embodiment will be described with reference to several schematic diagrams, and the particular embodiments are not limited to this example.

With the thermodynamic cycle 1 as the particular embodiment, the cycle is composed of two loops, wherein in a loop 1, the working substance firstly enters the turbo expander from the cylinder #3 A side, then enters the cylinder #2, and finally returns to the section A of the cylinder #3; in a loop 2, the working substance firstly enters the section B of the cylinder #3 from the cylinder #1, then enters the turbo expander, and finally returns to the cylinder #1; and the turbo expander is a power output mechanism when the working substance isothermal is subjected to the isothermal endothermic expansion.

Main components such as an airproof container, the cylinder #1 and the cylinder #2, the cylinder #3 and a turbo expander, a heat exchanger, a pressure control valve and a temperature control valve are required to complete one cycle, as shown in FIG. 1.

It is assumed that the cycle of the heat engine is an ideal Stirling cycle, the working substance is an ideal gas, the temperature of the heat reservoir is 600 K, the temperature of the cold source is 300 K, the inside pressure $P_{container}$ of the airproof container is 0.202 MPa, namely, $P_{container}$=0.202 MPa.

In FIGS. 2 and 3, a→depicts the working substance flowing through the expanding machine, which is an isothermal endothermic expansion process, where the kinetic energy of the working substance is transformed into the kinetic energy of the expanding machine, as shown in FIGS. 2 and 3.

It is assumed that $T_a$ is the temperature of the inlet of the turbo expander, $T_b$ is the temperature of the outlet of the turbo expander, $T_a$ and $T_b$ are also the temperature of the heat reservoir, $T_a$=$T_b$=600 K, $P_a$ is the pressure of the inlet of the turbo expander, and $P_b$ is the pressure of the outlet of the turbo expander.

At the beginning, the piston is located at the bottom of cylinder #1, and the inlet valve 7 thereof is opened and connected to the outlet of the turbo expander. The piston is then pushed towards the top of the cylinder #1 by the working substance from the turbo expander, this movement is similar to that of the intake stroke of the Otto cycle, the working substance enters the cylinder, and the inlet valve 7 is closed when the piston reaches the top of the cylinder #1. The piston remains in a fixed position at the top of the cylinder #1.

This is stage 1, now the cylinder #1 is filled with air whose temperature is 600 K and whose pressure is 0.202 MPa, and the section A of the cylinder #3 is filled with air whose temperature is 300 K and whose pressure is 0.202 MPa; the piston of the cylinder #2 is at the bottom of this cylinder, and the piston of the cylinder #3 is at the far left side of the cylinder #3; and there is no working substance remaining in the cylinder #2 and the section B of the cylinder #3, and all valves are closed, as shown in FIG. 4.

b→c shows that the working substance remains in the cylinder #1, which is an isochoric exothermic process. The temperature of the working substance then drops until it is equal to that of the environment, and $T_d=T_c=300$ K, where $T_c$ and $T_d$ represent the temperature of the environment.

Due to section A of the cylinder #3 extracting heat from the cylinder #1, the pressure of the cylinder #1 will drop until the temperature of the cylinder #1 is the same as that of the environment; and the pressure of the cylinder #1 will be lower than that of the airproof container, 0.101 MPa$=P_c<P_{container}=0.202$ MPa, where $P_c$ is the pressure which is after the isochoric exothermic process; and at this time, the piston of the cylinder #1 will be still in the fixed position at the top of the cylinder #1.

d→a shows that the working substance remains in the section A of the cylinder #3, which is an isochoric endothermic process. The section A of the cylinder #3 absorbs heat from the cylinder #1 by means of the heat exchanger, until its temperature is the temperature of the heat reservoir, $T_a=600$ K; the pressure in the section A of the cylinder #3 will rise to $P_a=0.404$ MPa; the piston of the cylinder #3 remains in the fixed position; and the outlet valve 12 in the section A of the cylinder #3 is opened and the inlet valve 10 of the cylinder #2 is opened at the same time, and the working substance enters the turbo expander and is subjected to the isothermal endothermic expansion process.

This is stage 2, now, the cylinder #1 is filled with the working substance whose temperature is 300 K and whose pressure is 0.101 MPa, the section A of the cylinder #3 is filled with the working substance whose temperature is 600 K and whose pressure is 0.404 MPa, the pistons of the cylinder #1 and the cylinder #3 will still be in their original positions; the piston of the cylinder #2 is at the bottom of cylinder #2, and the piston of the cylinder #3 is at the far left side of the cylinder #3, and there is no working substance remaining in the cylinder #2 and the section B of the cylinder #3; and the outlet valve 12 in the section A of the cylinder #3 is opened, the inlet valve 10 of the cylinder #2 is opened at the same time, and the other valves are closed, as shown in FIG. 5.

Since the outlet valve 12 in the section A of the cylinder #3 is opened and connected to turbo expander, and the inlet valve 10 of the cylinder #2 is opened too, the working substance will enter the cylinder #2, the pressure in the section A of the cylinder #3 will drop, until its pressure is the same as that of the airproof container, $P_d=P_{container}=P_b=0.202$ MPa, and the pistons of the cylinder #1 and the cylinder #3 will no longer be in their original positions.

The cylinder #1 and the cylinder #2 are connected to the airproof container, and the inside pressure of the airproof container is equal to that of the outlet of the turbo expander, namely, $P_{container}=P_b=0.202$ MPa.

c→d shows that the working substance stays in the cylinder #1, which is an isothermal exothermic compression and working process. At the beginning, since the inside pressure of the cylinder #1 is lower than that of the airproof container, the pressure in the airproof container will push the piston of the cylinder #1 to move, so as to compresses the working substance in the cylinder #1; consequently, the inside pressure of the cylinder #1 rises until it is the same as that of the airproof container.

Meanwhile, the outlet valve 8 of the cylinder #1 is opened and the piston moves towards the bottom of the cylinder #1, and after the working substance exits the cylinder #1, the outlet valve 8 is closed; and when the working substance leaves the cylinder #1, it enters the section B of the cylinder #3.

Due to the inertia, the piston of the cylinder #3 will also move towards the far right side of the cylinder #3, and the working substance in the loop 2 then exits the section A of the cylinder #3 and enters the turbo expander.

The piston is then pushed towards the top of the cylinder #2 by the working substance from the turbo expander, this movement is similar to that of the intake stroke of the Otto cycle, the working substance enters the cylinder, and the inlet valve 10 is closed when the piston reaches the top of the cylinder #2. The piston remains in a fixed position at the top of the cylinder #2.

This is stage 3, now, the cylinder #2 is filled with the working substance whose temperature is 600K and whose pressure is 0.202 MPa, the section B of the cylinder #3 is filled with the working substance whose temperature is 300K and whose pressure is 0.202 MPa, the pistons of the cylinder #2 and the cylinder #3 will still be in their original positions; the piston of the cylinder #1 is at the bottom of cylinder #1, and the piston of the cylinder #3 is at the far right side of the cylinder #3, and there is no working substance remaining in the cylinder #1 and the section A of the cylinder #3; and all the valves are closed, and the section B of the cylinder #3 will absorb heat from the cylinder #2, as shown in FIG. 6.

b→c shows that the working substance remains in the cylinder #2, which is an isochoric exothermic process. The temperature of the working substance will drop until it is equal to that of the environment, $T_d=T_c=300$ K, and after the isochoric exothermic process, the temperature of the cylinder #2 is lowered to $P_c=0.101$ MPa.

d→a depicts that the working substance is subjected to the isochoric endothermic heating process in the section B of the cylinder #3, and the section B of the cylinder #3 absorbs heat from the cylinder #2. After the isochoric endothermic heating process, the temperature of the section B of the cylinder #3 is 600 K, and the pressure thereof is 0.404 MPa.

This is stage 4, now, the cylinder #2 is filled with the working substance whose temperature is 300 K and whose pressure is 0.101 MPa, the section B of the cylinder #3 is filled with the working substance whose temperature is 600 K and whose pressure is 0.404 MPa, the pistons of the cylinder #2 and the cylinder #3 will still be in their original positions; the piston of the cylinder #1 is at the bottom of cylinder #1, and the piston of the cylinder #3 is at the far right side of the cylinder #3, and there is no working substance remaining in the cylinder #1 and the section A of the cylinder #3; and the outlet valve 11 in the section B of the cylinder #3 is opened, the inlet valve 7 of the cylinder #1 is opened at the same time, and the other valves are closed, as shown in FIG. 7.

The working substance will flow through the turbo expander, which is an isothermal endothermic expansion process; and when the working substance exits the turbo expander, it enters the cylinder #1.

Since the working substance enters the cylinder #1, the pressure in the section B of the cylinder #3 will drop, until its pressure is the same as that of the airproof container, $P_d=P_{container}=P_b=0.202$ MPa, and the pistons of the cylinder #2 and the cylinder #3 will no longer be in their original positions.

c→d shows that the working substance stays in the cylinder #2, which is an isothermal exothermic compression and working process. At the beginning, since the inside pressure of the cylinder #2 is lower than that of the airproof container, the pressure in the airproof container will push the piston of the cylinder #2 to move, so as to compresses the air in the cylinder #2; consequently, the inside pressure of the cylinder #2 rises until it is the same as that of the airproof container. Meanwhile, the outlet valve 9 of the cylinder #2 is opened and the piston moves towards the bottom of the cylinder #2, and after the working substance exits the cylinder #2, the outlet valve 9 is closed; and when the working substance leaves the cylinder #2, it enters the section A of the cylinder #3.

Due to the inertia, the piston of the cylinder #3 will move towards the far left side of the cylinder #3, and the working substance then exits the section B of the cylinder #3 and enters the turbo expander.

The piston is then pushed towards the top of the cylinder #1 by the working substance from the turbo expander, and the inlet valve 7 is closed when the piston reaches the top of the cylinder #1. The piston remains in a fixed position at the top of the cylinder #2.

The system returns to stage 1, now, the cylinder #1 is filled with the working substance whose temperature is 600K and whose pressure is 0.202 MPa, the section A of the cylinder #3 is filled with the working substance whose temperature is 300 K and whose pressure is 0.202 MPa, the pistons of the cylinder #1 and the cylinder #3 will still be in their original positions; the piston of the cylinder #2 is at the bottom of cylinder #2, and the piston of the cylinder #3 is at the far left side of the cylinder #3, and there is no working substance remaining in the cylinder #2 and the section B of the cylinder #3; and all the valves are closed, and the section A of the cylinder #3 will absorb heat from the cylinder #1, as shown in FIG. 4.

Thus, the heat engine completes one cycle.

Traditional Stirling cycle heat engines need to consume the work done by the working substance in the isothermal endothermic expansion process to complete the isothermal exothermic compression process, and the power output from the traditional Stirling cycle heat engines will be smaller than the work done by the working substance in the isothermal endothermic expansion process of the system; and this heat engine uses the pressure in the airproof container to do work to complete the isothermal exothermic compression process, and does not consume the work done by the working substance in the isothermal endothermic expansion process to complete the isothermal exothermic compression process, and the work done by the pressure in the airproof container can be used by and output from this heat engine; therefore, the power output from this heat engine will be greater than power output from the traditional Stirling cycle heat engines in the same operating conditions.

What is claimed is:

1. A heat engine, using air, water or a refrigerant as a working substance, the heat engine comprising a thermodynamic cycle being able to output power, wherein the thermodynamic cycle is similar to a Stirling cycle and is composed of four processes: an isothermal exothermic compression process, an isochoric endothermic heating process, an isothermal endothermic expansion process and an isochoric exothermic cooling process, the thermodynamic cycle is composed of two loops, and the heat engine comprises a cylinder #1, a cylinder #2, a cylinder #3, a turbo expander or a double-shaft double-acting cylinder, a heat exchanger, a pressure control valve, a temperature control valve, and an airproof container, the working substance is subjected to the isochoric exothermic cooling process in the cylinder #1 and the cylinder #2, and is then subjected to the isothermal exothermic compression process by virtue of pressure in the airproof container, the working substance in the cylinder #3 absorbs heat from a heat reservoir and heat released from the cylinder #1 and the cylinder #2, the working substance is subjected to the isochoric endothermic heating process in the cylinder #3, and the working substance in the turbo expander or the double-acting cylinder absorbs the heat from the heat reservoir and is subjected to the isothermal endothermic expansion process.

2. The heat engine according to claim 1, wherein in a loop 1 of the two loops, the working substance firstly enters the turbo expander or the double-shaft double-acting cylinder from a section A of the cylinder #3, then enters the cylinder #2, and finally returns to the section A of the cylinder #3; and in a loop 2 of the two loops, the working substance firstly enters a section B of the cylinder #3 from the cylinder #1, then enters the turbo expander or the double-shaft double-acting cylinder, and finally returns to the cylinder #1.

3. The heat engine according to claim 1, wherein the cylinder #1 and the cylinder #2 are double-acting cylinders, structures and volumes of the cylinder #1 and the cylinder #2 are the same, an air hole on a rodless side of the cylinder #1 is connected to an opening of a T-connector #1, two other openings of the T-connector #1 are respectively connected with an inlet valve and an outlet valve of the cylinder #1, the inlet valve of the cylinder #1 is connected to a first outlet of the turbo expander or a first air hole of the double-shaft double-acting cylinder, the outlet valve of the cylinder #1 is connected to a first inlet of the cylinder #3, an air hole on a rodless side of the cylinder #2 is connected to an opening of a T-connector #2, two other openings of the T-connector #2 are respectively connected with an inlet valve and an outlet valve of the cylinder #2, the inlet valve of the cylinder #2 is connected to a second outlet of the turbo expander or a second air hole of the double-shaft double-acting cylinder, the outlet valve of the cylinder #2 is connected to a second inlet of the cylinder #3, and air holes on rod sides of the cylinder #1 and the cylinder #2 are connected to the airproof container.

4. The heat engine according to claim 1, wherein the airproof container is filled with normal pressure or high pressure air, and pressure of an outlet of the turbo expander or the double-shaft double-acting cylinder is greater than or equal to the air pressure in the airproof container.

5. The heat engine according to claim 1, wherein the cylinder #3 is a double-acting cylinder having a volume equal to that of the cylinder #1 and the cylinder #2, a piston of the cylinder #3 divides the cylinder #3 into two sections A and B, two sides of the piston have a same pressure-receiving area, the working substance is subjected to the isochoric endothermic heating process in the cylinder #3, and an air hole of the section A of the cylinder #3 is connected to a first opening of a T-connector #A3, a second opening of the T-connector #A3 is connected to the turbo expander or the double-shaft double-acting cylinder by a first outlet valve of the cylinder #3, a third opening of the T-connector #A3 is connected to the cylinder #1 by a valve acted as an outlet valve of the cylinder #1 and an inlet valve of the section A of the cylinder #3; an air hole of the section B of the cylinder #3 is connected to a first opening of a T-connector #B3, a second opening of the T-connector #B3 is connected to the turbo expander or the double-shaft double-acting cylinder by a second outlet valve of the cylinder #3, a third opening of the T-connector #B3 is connected to the cylinder #2 by a valve acted as an outlet valve of the cylinder #2 and an inlet valve of the section B of the cylinder #3.

6. The heat engine according to claim 5, wherein the section A of the cylinder #3 absorbs the heat from the heat reservoir and the heat released from the cylinder #1, the working substance is subjected to the isochoric endothermic heating process in the section A of the cylinder #3, the working substance is firstly subjected to the isochoric exothermic cooling process in the cylinder #1; when temperature of the section A of the cylinder #3 is equal to temperature of the heat reservoir, the first outlet valve between the section A of the cylinder #3 and the turbo expander or the double-shaft double-acting cylinder is opened, and the working substance does work on the turbo expander or the double-shaft double-acting cylinder; when pressure of the section A of the cylinder #3 is equal to the pressure in the airproof container, a piston of the cylinder #1 is released and the pressure in the airproof container does work on the working substance in the cylinder #1, which work is used by the heat engine, and the working substance is subjected to the isothermal exothermic compression process in the cylinder #1; and the section B of the cylinder #3 absorbs the heat from the heat reservoir and the heat released from the cylinder #2, the working substance is subjected to the isochoric endothermic heating process in the section B of the cylinder #3, the working substance is firstly subjected to the isochoric exothermic cooling process in the cylinder #2; when temperature of the section B of the cylinder #3 is equal to the temperature of the heat reservoir, the second outlet valve between the section B of the cylinder #3 and the turbo expander or the double-shaft double-acting cylinder is opened, and the working substance does work on the turbo expander or the double-shaft double-acting cylinder; when pressure of the section B of the cylinder #3 is equal to the pressure in the airproof container, a piston of the cylinder #2 is released and the pressure in the airproof container does work on the working substance, which work is used by the heat engine, and the working substance is subjected to the isothermal exothermic compression process in the cylinder #2.

7. The heat engine according to claim 2, wherein all the valves are closed at the beginning, a piston of the cylinder #3 is at an end of the section B of the cylinder #3, there is no working substance remaining in the section B of the cylinder #3, a piston of the cylinder #2 is situated at a bottom of the cylinder #2, and a piston of the cylinder #1 is situated at a top of the cylinder #1; in the loop 1, initially, pressure of the working substance in the cylinder #1 is equal to the pressure in the airproof container and temperature of the working substance in the cylinder #1 is equal to temperature of the heat reservoir, and pressure of the working substance in the section A of the cylinder #3 is equal to the pressure in the airproof container and temperature of the working substance in the section A of the cylinder #3 is equal to a room temperature; the working substance is firstly subjected to the isochoric exothermic process in the cylinder #1, the heat is transferred to the working substance in the section A of the cylinder #3; when the temperature of the working substance in the section A of the cylinder #3 rises to be equal to the temperature of the heat reservoir, an outlet valve of the section A of the cylinder #3 is opened and an inlet valve of the cylinder #2 is opened at a same time, the working substance then enters the turbo expander or the double-shaft double-acting cylinder from the section A of the cylinder #3 and does work on the turbo expander or the double-shaft double-acting cylinder, the working substance enters the cylinder #2 after exiting the turbo expander or the double-shaft double-acting cylinder; and when the piston of the cylinder #2 moves to a top of the cylinder #2, the piston of the cylinder #2 remains in a fixed position at the top of the cylinder #2, in this case, pressure of the working substance in the cylinder #2 is equal to the pressure in the airproof container and temperature of the working substance in the cylinder #2 is equal to the temperature of the heat reservoir; when the pressure of the section A of the cylinder #3 is equal to the pressure in the airproof container, and the temperature of the working substance in the cylinder #1 is equal to the room temperature, the piston of the cylinder #1 is released, an outlet valve of the cylinder #1 is opened at a same time, the pressure in the airproof container does work on the working substance, which work is used by the heat engine, this process is the isothermal exothermic compression and working process, after which the piston of the cylinder #3 is pushed to an end of the section A, and the working substance, which is originally in the cylinder #1, enters the section B of the cylinder #3, in this case, the piston of the cylinder #1 is situated at a bottom of the cylinder #1, there is no working substance remaining in the cylinder #1, and pressure of the working substance in the section B of the cylinder #3 is equal to the pressure in the airproof container and temperature of the working substance in the section B of the cylinder #3 is equal to the room temperature; and in the loop 2, the working substance is firstly subjected to the isochoric exothermic process in the cylinder #2, the heat is transferred to the working substance in the section B of the cylinder #3; when the temperature of the working substance in the section B of the cylinder #3 rises to be equal to the temperature of the heat reservoir, an outlet valve of the section B of the cylinder #3 is opened and an inlet valve of the cylinder #1 is opened at a same time, the working substance then enters the turbo expander or the double-shaft double-acting cylinder from the section B of the cylinder #3 and does work on the turbo expander or the double-shaft double-acting cylinder, the working substance enters the cylinder #1 after exiting the turbo expander or the double-shaft double-acting cylinder; and when the piston of the cylinder #1 moves to the top of the cylinder #1, the piston of the cylinder #1 remains in a fixed position at the top of the cylinder #1, in this case, the pressure of the working substance in the cylinder #1 is equal to the pressure in the airproof container and the temperature of the working substance in the cylinder #1 is equal to the temperature of the heat reservoir, and the heat engine completes one cycle.

* * * * *